US005791011A

United States Patent [19]

Richter et al.

[11] Patent Number: 5,791,011

[45] Date of Patent: Aug. 11, 1998

[54] ROPE CLEANING DEVICE

[75] Inventors: Jesse R. Richter, West Hartford, Conn.; Paul J. Willett, Allen, Tex.

[73] Assignee: Otis Elevator Company, Farmington, Conn.

[21] Appl. No.: 819,232

[22] Filed: Mar. 17, 1997

[51] Int. Cl.[6] ..... A46B 7/10; A46B 13/00

[52] U.S. Cl. ..... 15/256.6; 15/88.1; 15/231; 474/92; 187/414; 184/15.1

[58] Field of Search ..... 15/233, 231, 256.51, 15/256.6, 256.5, 88, 88.1; 474/92; 187/414; 184/15.1, 21

[56] References Cited

U.S. PATENT DOCUMENTS

| | | | |
|---|---|---|---|
| 1,530,950 | 3/1925 | Kocian et al. | 15/256.6 |
| 1,677,366 | 7/1928 | Pickering | 15/231 |
| 1,931,887 | 10/1933 | Becker | 15/256.6 |
| 2,585,061 | 2/1952 | Wester, Jr. | 15/231 |
| 3,274,633 | 9/1966 | Stevenson | 15/88 |
| 5,036,563 | 8/1991 | Liebing | 15/256.6 |
| 5,386,882 | 2/1995 | Friend | 184/15.3 |

*Primary Examiner*—Gary K. Graham

[57] ABSTRACT

A device for cleaning elevator ropes includes a carpet strip clamped to be in contact with the elevator ropes and includes an additional supply roll of carpet. Once the portion of the carpet strip that comes into contact with the elevator ropes becomes soiled, the carpet strip can be advanced so that a clean portion of the carpet strip is positioned to be in contact with the elevator ropes and the soiled portion of the carpet strip is discarded. The carpet strip is secured by a pair of labyrinth type clamps that can be loosened and tightened without use of additional tools.

6 Claims, 3 Drawing Sheets

10
34
32
50
20
28
38
30
16
24
14
12
26
18
50
36

FIG.2
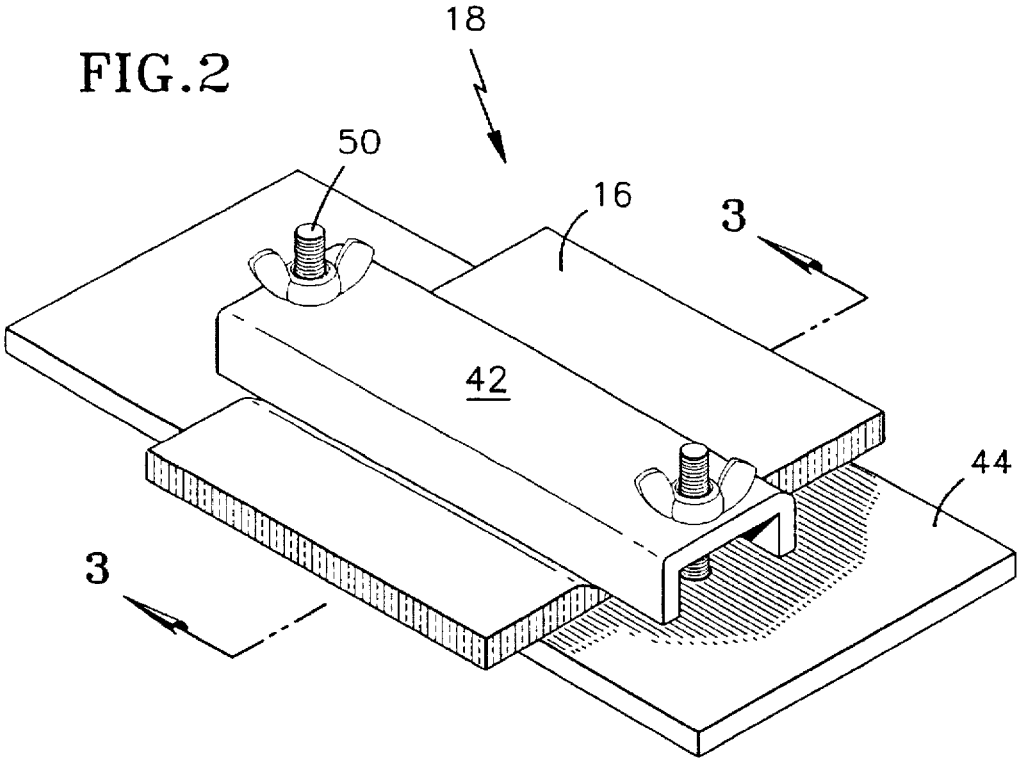
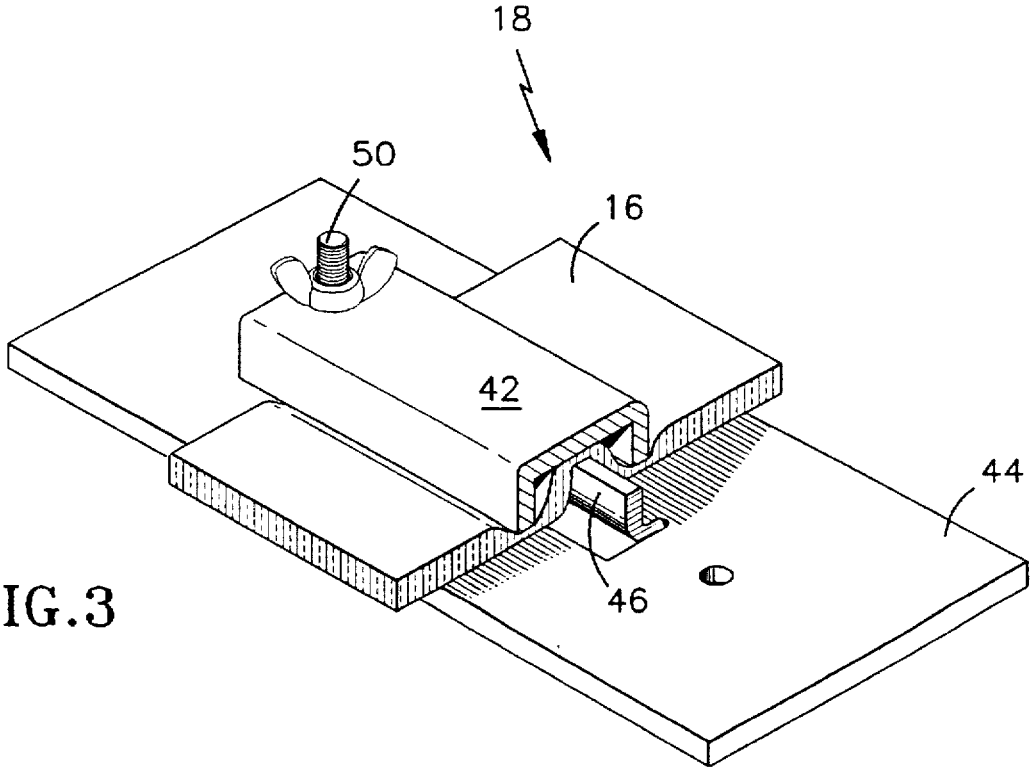
FIG.3

ROPE CLEANING DEVICE

TECHNICAL FIELD

The present invention relates to elevator ropes and, more particularly, to a cleaning device therefor.

BACKGROUND OF THE INVENTION

The ropes in elevator systems are typically treated with a lubricating oil to prolong the life of the ropes. The oil lubricates the inside wires and reduces wear caused by friction between the wires. However, the lubricating oil collects dust and dirt forming a dark, heavy sludge build-up. As the elevator ropes travel through the hoistway, covered with the sludge, a number of potential problems arise. One problem with sludge covering the elevator rope is that the sludge buildup prevents new lubricating oil from penetrating through to the core of the elevator rope, therefore increasing the wear and reducing the life of the rope. Another problem with the sludge is that it leaves permanent stains on the rugs, carpeting and clothing resulting in numerous customer complaints. Since the sludge is splashed throughout the machine room as the elevator ropes travel through the hoistway, sludge often remains on the mechanic's clothing when the mechanic leaves the machine room and walks through the lobbies of the buildings, thereby permanently damaging the floor coverings on the site. Yet another downside of sludge build-up is potential increased fire hazard because the sludge is flammable.

Currently, most ropes are cleaned manually. Manual cleaning of the ropes is a labor intensive and messy process. It is very time consuming and often not effective to manually clean many long ropes located in very tight places with restricted access to the ropes. Also, the sludge gets on the mechanic's clothing and shoes and is spread throughout the lobbies of buildings causing many customer complaints.

Besides manual cleaning process, brushes and carpet type cleaners have been used to clean elevator ropes. One type of cleaning device for elevator ropes is described in U.S. Pat. No. 5,386,882 to Friend, entitled "Wire Rope Cleaning Brush Apparatus." However, the bristles of the brush cleaning device described splatters sludge within the hoistway, thereby increasing the problem of damaging floor coverings and increasing the potential for fire. Additionally, abrasive brushes may damage the rope surfaces over time.

The existing carpet rope cleaners use a fixed length strip of carpet bolted on both ends. The replacement procedure for the existing carpet rope cleaners is labor intensive and time consuming. Typically, the mechanic must carry a wrench to unscrew the bolts securing the ends of the carpet. Then, the mechanic must remove the bolts and replace the soiled rug with a new strip which must be properly lined up so that the holes formed in the rug fit onto the bolts and then secure the bolts. Furthermore, after the portion of the carpet strip that comes into contact becomes saturated with sludge, the entire carpet strip must be replaced. Thus, a more efficient device and method for cleaning elevator ropes is desired.

DISCLOSURE OF THE INVENTION

It is an object of the present invention to provide a cleaning device for removing sludge from elevator ropes without contaminating the hoistway and the machine room.

It is a further object of the present invention to provide a rope cleaning device that would not require labor intensive and time consuming replacement or cleaning procedure.

According to the present invention, a rope cleaning device includes a carpet strip secured by a plurality of clamps and positioned to be in contact with a plurality of elevator ropes with one end of the carpet strip extending to form a supply roll of carpet, stored in a supply roll housing. As the portion of the carpet strip that comes into contact with the ropes becomes soiled, the supply roll is used for providing a clean portion of the carpet strip.

A feature of the present invention is a pair of labyrinth clamps securing the carpet strip. Each clamp includes a top channel and bottom plate with a protruding tab interacting with the top channel to form a carpet strip path. The top channel and the bottom plate are fastened together by means of fasteners disposed outside of the carpet strip path. One benefit of the labyrinth clamps is that holes need not be made in the carpet. Another benefit is that the labyrinth clamps of the present invention can be loosened and tightened during the replacement procedures without special tools, such as wrenches. Additionally, during the replacement procedure, the carpet strip can be pulled through the loosened clamps without requiring a disassembling procedure.

One advantage of the present invention is that only a portion of the carpet strip that is soiled is discarded, rather than the entire span of the carpet.

The foregoing and other advantages of the present invention become more apparent in light of the following detailed description of the exemplary embodiments thereof, as illustrated in the accompanying drawings.

BRIEF DESCRIPTION OF THE DRAWINGS

FIG. 2 is an enlarged, schematic, perspective view of a labyrinth clamp securing a carpet strip of the rope cleaning device of FIG. 1;

FIG. 3 is a cut away, schematic, perspective view of the labyrinth clamp of FIG. 2 taken along line 3—3;

BEST MODE FOR CARRYING OUT THE INVENTION

Figure 1:
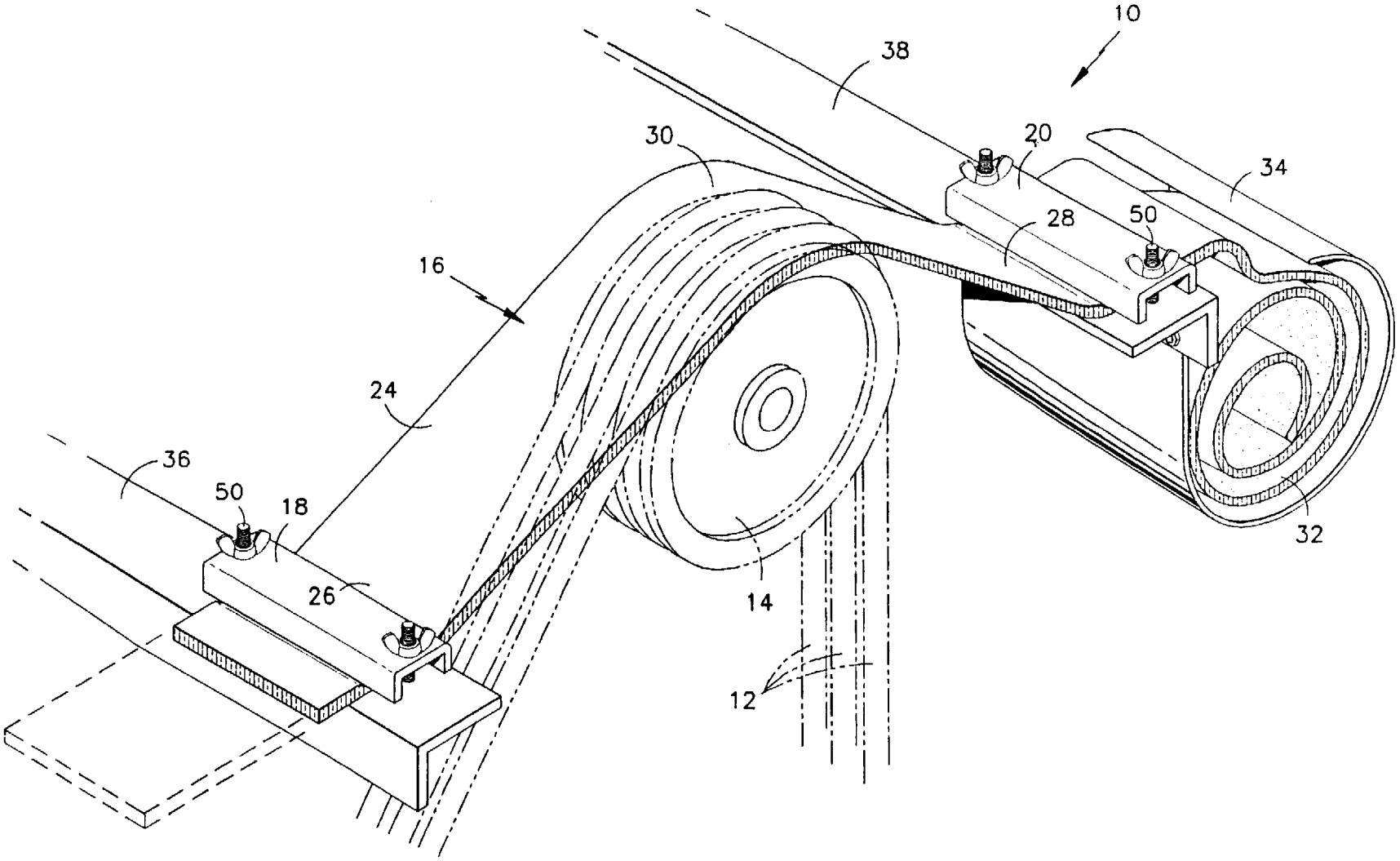
FIG. 1 is a schematic, perspective view of a rope cleaning device, according to the present invention.

Referring to FIG. 1, a rope cleaning device 10 is positioned adjacent to a plurality of elevator ropes 12 passing over a rope sheave 14. The cleaning device 10 includes a carpet strip 16 secured by a first clamp 18 and a second clamp 20. The carpet strip 16 includes an intermediate portion 24 disposed between a first clamped end 26 and a second clamped end 28 of the carpet strip 16. The intermediate portion 24 of the carpet strip 16 includes a contact section 30 that comes into contact with the elevator ropes 12. The second clamped end 28 of the carpet strip 16 extends outward past the second clamp 20 to form a supply roll 32 of carpet stored in a supply roll housing 34. A pair of brackets 36, 38 are mounted to an elevator machine (not shown) and support the first and second clamps 18, 20, respectively. The supply roll housing 34 is attached to the second bracket 38.

Referring to FIGS. 2 and 3, in the preferred embodiment of the present invention, the first and second clamps 18, 20 are labyrinth type clamps and include a top channel 42 and a bottom plate 44 having a protruding tab 46 to form a labyrinth carpet path for the carpet strip 16 to pass therethrough. A pair of fasteners 50, disposed outside of the carpet path, clamp the top channel 42 and the bottom plate 44 together to secure the carpet strip 16 therebetween. Each fastener 50 includes a threaded stud and a wing nut. The fasteners 50 can be loosened and tightened by hand without the use of extraneous tools, such as wrenches.

Figure 4:
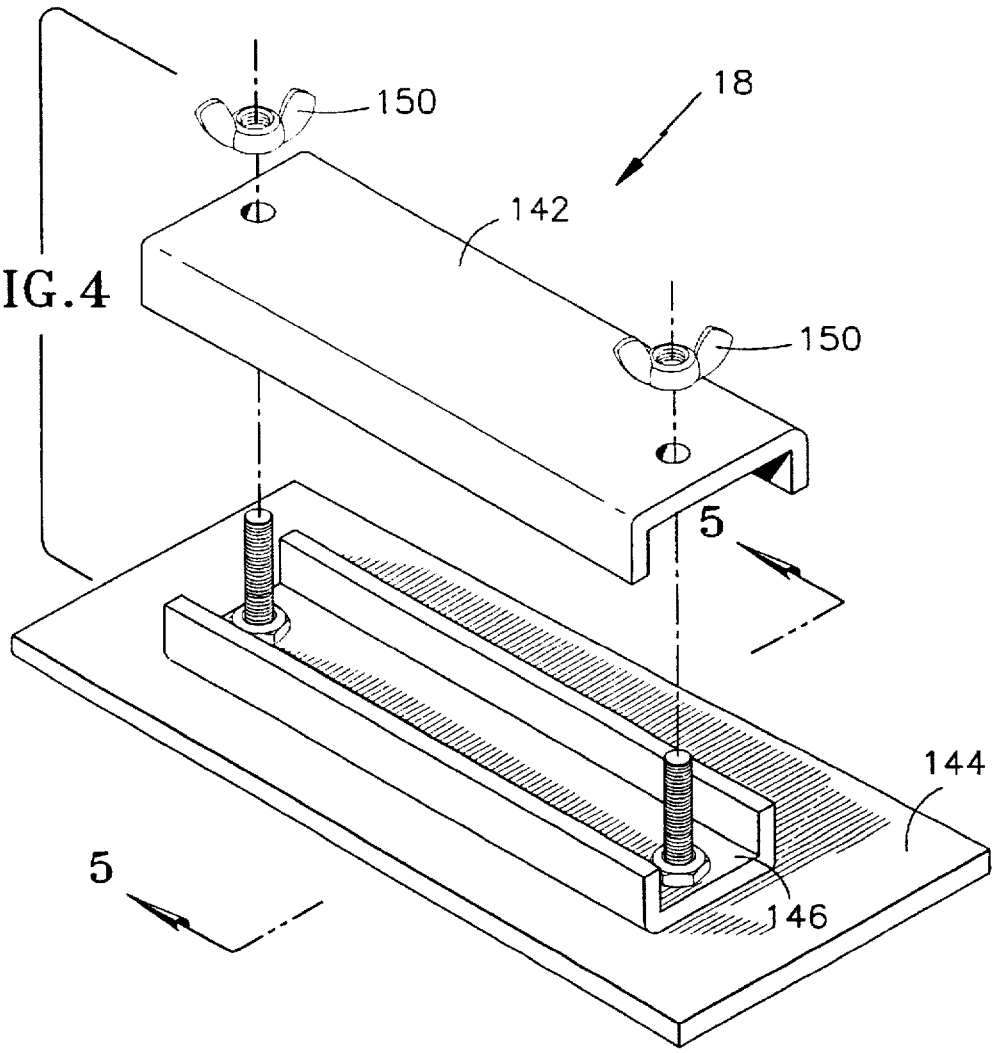
FIG. 4 is an exploded, schematic, perspective view of another embodiment of a labyrinth clamp securing a carpet strip of the cleaning device of FIG. 1.
Figure 5:
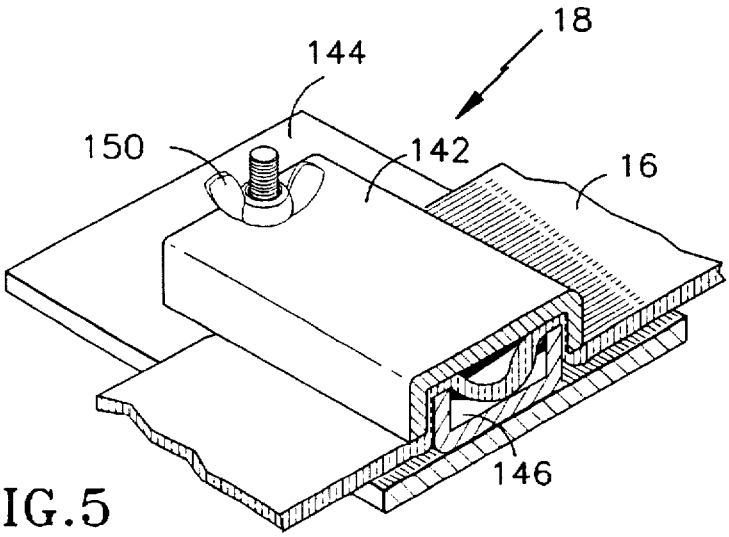
FIG. 5 is a cut away, schematic, perspective view of the labyrinth clamp of FIG. 4 taken along line 5—5.

Referring to FIGS. 4 and 5, an alternate embodiment of the labyrinth clamp 18 includes a top channel 142 and a smaller sized bottom channel 146. The bottom channel 146 is fixedly attached to the bottom plate 144 and cooperates with the top channel 142 to form a labyrinth carpet path for the carpet strip 16. The fasteners 150 are disposed outside of the carpet path and can be loosened and tightened by hand.

In operation, as the elevator ropes 12 travel passing over the sheave 14, the contact section 30 of the carpet strip 16 comes in contact with the ropes, removing the sludge therefrom. As the contact section 30 of the carpet strip 16 becomes saturated with sludge, a maintenance person can quickly and easily advance the carpet strip 16 to remove the soiled carpet. A maintenance person would first manually loosen the wing nuts of the fasteners 50 on the first and second clamps 18, 20 securing the carpet. The procedure would not require any tools. Then, the first clamped end 26 of the carpet strip 16 can be pulled through the first clamp 18 and advanced until the soiled contact portion 30 of the carpet strip 16 passes the area of contact with the ropes 12. The fasteners 50 of the clamps 18, 20 are tightened and the carpet strip protruding from the first clamp 18 is cut and discarded.

One major advantage of the present invention is the ease of replacing the soiled carpet with clean carpet. The configuration of the present invention does not require disassembly of the device, but rather a mere loosening and tightening of the wing nuts of the fasteners securing parts of the clamps. Furthermore, the fasteners can be loosened and tightened without the use of additional tools. The configuration of the present invention saves time, and subsequently costs during regular replacement procedures.

Additionally, the present invention translates into cost savings of material. Only the soiled portion of the carpet is replaced each time rather than the entire intermediate portion of the carpet disposed between the clamps.

While the present invention has been illustrated and described with respect to a particular embodiment thereof, it should be appreciated by those of ordinary skill in the art, that various modifications to this invention may be made without departing from the spirit and scope of the present invention. For example, the brackets 36, 38 can also serve as the bottom plate 44, 144 of the labyrinth clamps 18, 20.

We claim:

1. In an elevator system including elevator ropes traveling through a hoistway wherein a rope cleaning device is adapted to clean said elevator ropes, said cleaning device comprising:

a first support bracket including a first clamp, a second support bracket including a second clamp, an elongated carpet strip being clamped at an end thereof in said first clamp and extending to and through said second clamp to define a continuous supply roll adjacent said second clamp, said second clamp clamping said carpet strip such that an intermediate portion of said strip between said clamps comes into contact with said elevator ropes for removing sludge therefrom.

2. In an elevator system according to claim 1, wherein said supply roll of said carpet strip is stored within a supply roll housing.

3. The rope cleaning device according to claim 1, wherein said first and said second clamps are labyrinth type clamps.

4. In an elevator system according to claim 3, wherein said labyrinth type clamp includes:

a top channel;

a bottom plate with a protruding tab that cooperates with said top channel to form a carpet path; and a plurality of fasteners disposed outside of said carpet path and securing said top channel and said bottom plate with said carpet strip therebetween.

5. In an elevator system according to claim 3, wherein said labyrinth type clamp includes:

a top channel;

a bottom plate with a bottom channel protruding therefrom, said bottom channel being smaller than said top channel, said top channel cooperating with said bottom channel to form a carpet path; and a plurality of fasteners disposed outside of said carpet path and securing said top channel and said bottom plate with said carpet strip therebetween.

6. In an elevator system including elevator ropes traveling through a hoistway wherein a rope cleaning device is adapted to clean said elevator ropes, said cleaning device comprising:

a first support bracket including a first clamp, a second support bracket including a second clamp, an elongated carpet strip being clamped at an end thereof in said first clamp and extending to and through said second clamp to define a continuous supply roll adjacent said second clamp, said second clamp clamping said carpet strip such that an intermediate portion of said strip between said clamps comes into contact with said elevator ropes for removing sludge therefrom, a supply roll housing for storing said supply roll of said carpet strip.

* * * * *